United States Patent [19]

Silverberg

[11] Patent Number: 4,596,385

[45] Date of Patent: Jun. 24, 1986

[54] TOP VACUUM CORRUGATION FEEDER WITH MOVEABLE AIR BLOCKING VANE

[75] Inventor: Morton Silverberg, Rochester, N.Y.

[73] Assignee: Xerox Corporation, Stamford, Conn.

[21] Appl. No.: 654,704

[22] Filed: Sep. 27, 1984

[51] Int. Cl.[4] ..... B65H 3/48; B65H 3/64

[52] U.S. Cl. ..... 271/94; 271/98; 271/108

[58] Field of Search ..... 271/90, 94, 97, 98, 271/108; 414/121, 124, 116; 221/278

[56] References Cited

U.S. PATENT DOCUMENTS

| | | | |
|---|---|---|---|
| 2,085,612 | 6/1937 | Speiss | 271/98 |
| 2,722,416 | 11/1955 | Backhouse | 271/108 |
| 2,764,407 | 9/1956 | Alix | 271/108 |
| 2,895,552 | 7/1959 | Pomper et al. | 164/68 |
| 2,979,329 | 4/1961 | Cunningham | 271/29 |
| 3,218,062 | 11/1965 | Wickland | 271/98 |
| 3,226,107 | 12/1965 | Staines | 271/93 |
| 3,294,396 | 12/1966 | Staines | 271/98 |
| 3,424,453 | 1/1969 | Halbert | 271/35 |
| 4,157,177 | 6/1979 | Strecker | 271/197 |
| 4,268,025 | 5/1981 | Murayoshi | 271/112 |
| 4,382,593 | 5/1983 | Beran et al. | 271/98 |
| 4,418,905 | 12/1983 | Garavuso | 271/98 |
| 4,451,028 | 5/1984 | Holmes et al. | 271/11 |

FOREIGN PATENT DOCUMENTS

| | | |
|---|---|---|
| 674842 | 7/1952 | United Kingdom . |
| 1283654 | 8/1972 | United Kingdom . |
| 1428804 | 3/1976 | United Kingdom . |
| 1561264 | 2/1980 | United Kingdom . |

OTHER PUBLICATIONS

Anderson et al., "Document Feeder and Separator"; IBM Tech. Disc. Bull., vol. 6, No. 2, p. 32, 1963.

*Primary Examiner*—Bruce H. Stoner, Jr.
*Assistant Examiner*—James E. Barlow
*Attorney, Agent, or Firm*—William A. Henry, II

[57] ABSTRACT

A top vacuum corrugation feeder is disclosed that employs a moveable air blocking vane capable of redirecting the flow of air from an air knife. The moveable vane when in a first position allows air to exit the air knife toward a stack of sheets uninterrupted. Alternatively, when the vane is moved to a second position, air flow from the air knife is interrupted to thereby allow an increased vacuum in a vacuum means adapted to lift the top sheet off the stack for feeding.

5 Claims, 3 Drawing Figures

TOP VACUUM CORRUGATION FEEDER WITH MOVEABLE AIR BLOCKING VANE

BACKGROUND OF THE INVENTION

This invention relates to an electrophotographic printing machine, and more particularly, concerns an improved top vacuum corrugation feeder for such a machine.

With the advent of high speed xerographic copy reproduction machines wherein copies can be produced at a rate in excess of several thousand copies per hour, the need for a sheet feeder to feed cut copy sheets to the machine in a rapid, dependable manner was recognized to enable full utilization of the reproduction machine's potential copy output. In particular for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

Since the sheets must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face can cause smearing or partial erasure of the printed material on the document. With single sided documents if the image is against the retard mechanism, it can be smeared or erased. On the other hand, if the image is against the feed belt it smears through ink transfer and offset back to the paper. However, with documents printed on both sides the problem is compounded. Additionally, the reliable operation of friction retard feeders is highly dependent on the relative frictional properties of the paper being handled. This cannot be controlled in a document feeder.

One of sheet feeders best known for high speed operation is the top vacuum corrugation feeder with front air knife. In this system, a vacuum plenum with a plurality of friction belts arranged to run over the vacuum plenum is placed at the top of a stack of sheets in a supply tray. At the front of the stack, an air knife is used to inject air into the stack to separate the top sheet from the remainder of the stack. In operation, air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In this type of feeding system every operation takes place in succession or serially and therefore the feeding of subsequent sheets cannot be started until the feeding of the previous sheet has been completed. In addition, in this type of system the air knife may cause the second sheet to vibrate independent of the rest of the stack in a manner referred to as "flutter". When the second sheet is in this situation, if it touches the top sheet, it may tend to creep forward slightly with the top sheet. The air knife then may drive the second sheet against the first sheet causing a shingle or double feeding of sheets.

PRIOR ART

U.S. Pat. No. 2,979,329 (Cunningham) describes a sheet feeding mechanism useful for both top and bottom feeding of sheets wherein an oscillating vacuum chamber is used to acquire and transport a sheet to be fed. In addition, an air blast is directed to the leading edge of a stack of sheets from which the sheet is to be separated and fed to assist in separating the sheets from the stack.

U.S. Pat. No. 3,424,453 (Halbert) illustrates a vacuum sheet separator feeder with an air knife wherein a plurality of feed belts with holes are transported about a vacuum plenum and pressurized air is delivered to the leading edge of the stack of sheets. This is a bottom sheet feeder.

U.S. Pat. No. 2,895,552 (Pomper et al.) illustrates a vacuum belt transport and stacking device wherein sheets which have been cut from a web are transported from the sheet supply to a sheet stacking tray. Flexible belts perforated at intervals are used to pick up the leading edge of the sheet and release the sheet over the pile for stacking.

U.S. Pat. No. 4,157,177 (Strecker) illustrates another sheet stacker wherein a first belt conveyor delivers sheets in a shingled fashion and the lower reach of a second perforated belt conveyor which is above the top of the stacking magazine attracts the leading edge of the sheets. The device has a slide which limits the effect of perforations depending on the size of the shingled sheet.

U.S. Pat. No. 4,268,025 (Murayoshi) describes a top sheet feeding apparatus wherein a sheet tray has a vacuum plate above the tray which has a suction hole in its bottom portion. A feed roll in the suction hole transports a sheet to a separating roll and a frictional member in contact with the separating roll.

U.S. Pat. No. 4,418,905 (Garavuso) shows a vacuum corrugation feeding system.

U.S. Pat. No. 4,451,028 (Holmes et al.) discloses a top feed vacuum corrugation system that employs front and back vacuum plenums.

SUMMARY OF THE INVENTION

It is an object of the present invention to provide an improve sheet separator feeder.

It is an additional object of the present invention to provide an improved high speed sheet separator feeder.

It is an additional object of the present invention to provide a more efficient and more reliable high speed sheet separator feeder.

It is an additional object of the present invention to provide a top vacuum corrugation sheet feeder in which the air knife flow does not fight with the vacuum flow.

These and other objects are attained with a sheet feeding apparatus comprising a sheet stack support tray, a vacuum plenum chamber positioned over the front of a stack of sheets when sheets are placed in the tray, sheet transport means associated with said vacuum plenum to transport the sheets acquired by said vacuum plenum in a forward direction out of the sheet stack support tray, air knife means positioned adjacent the front of said stack of sheets for applying a positive pressure to the sheet stack in order to separate the uppermost sheet from the rest of the stack, and air blocking vane means positionable between blocking and non-blocking positions in relation to said air knife means. Means are provided to move said air blocking vane means into its blocking position to increase vacuum efficiency and into its non-blocking position to increase air knife efficiency.

For a better understanding of the invention as well as other objects and further featues thereof, reference is made to the following drawings and descriptions.

DESCRIPTION OF THE PREFERRED EMBODIMENT

While the present invention will be described hereinafter in connection with a preferred embodiment thereof, it will be understood that it is not intended to limit the invention to that emboidment. On the contrary, it is intended to cover all alternatives, modifications, and equivalents as may be included within the spirit and scope of the invention as defined by the appended claims.

Figure 1:
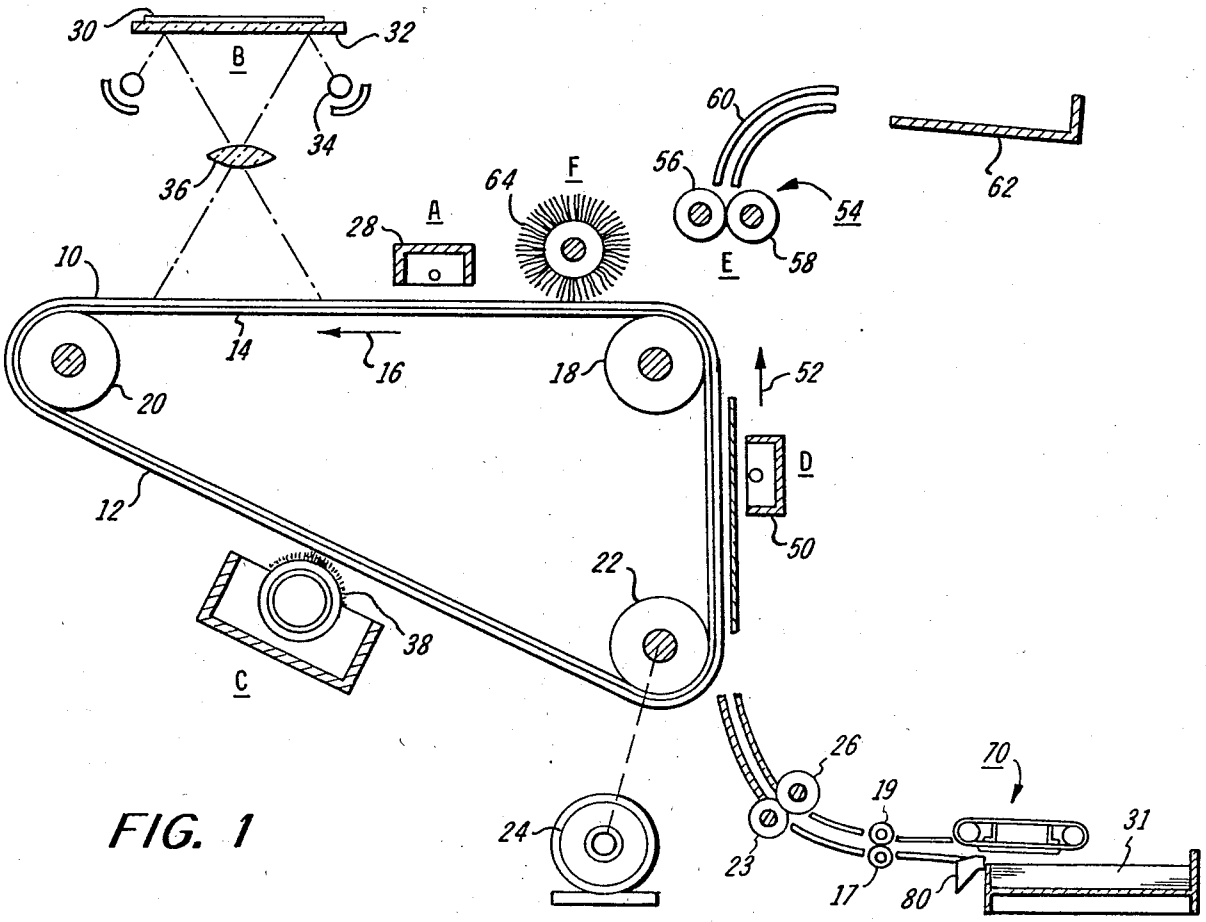
FIG. 1 is a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the top feed vacuum corrugation feeder method and apparatus of the present invention therein. It will become evident from the following discussion that the sheet feeding system disclosed herein is equally well suited for use in a wide variety of devices and is not necessarily limited to its application to the particular embodiment shown herein. For example, the apparatus of the present invention may be readily employed in non-xerographic environments and substrate transportation in general.

Inasmuch as the art of electrophotographic printing is well known, the various processing stations employed in the FIG. 1 printing machine will be shown hereinafter schematically and the operation described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Driver roller 22 is mounted rotatably in engagement with belt 10. Roller 22 is coupled to a suitable means such as motor 24 through a belt drive. Motor 24 rotates roller 22 to advance belt 10 in the direction of arrow 16. Drive roller 22 includes a pair of opposed spaced flanges or edge guides (not shown). Preferably, the edge guides are circular members or flanges.

Belt 10 is maintained in tension by a pair of springs (not shown), resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductive surface 12 of the belt 10 to a relatively high, substantially uniform potential.

Next, the charged portion of photoconductive surface 12 is advanced through exposure station B. At exposure station B, an original document 30 is positioned face down upon transparent platen 32. Lamps 34 flash light rays onto original doument 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 which corresponds to the information areas contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material is moved into contact with the toner powder image. The sheet support material is advanced toward transfer station D by top vacuum corrugation feeder 70. Preferably, the feeder includes an air knife 80 which floats a sheet 31 up to where it is grabbed by the suction force from vacuum plenum 75. A perforated feed belt 71 then forwards the now separated sheet for further processing, i.e., the sheet is directed through rollers 17, 19, 23 and 26 into contact with the photoconductive surface 12 of belt 10 in a timed sequence by suitable conventional means so that the toner powder image developed thereon synchronously contacts the advancing sheet of support material at transfer station D.

Transfer statin D includes a corona generating device 50 which sprays ions onto the backside of a sheet passing through the statin. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicted generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

Invariably, after the sheet support material is separated from the photoconductive surface 12 of belt 10, some residual particles remain adhering thereto. These residual particles are removed from photoconductive surface 12 at cleaning station F. Cleaning station F includes a rotatably mounted brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient to illustrate the general operation of an electrostatographic machine.

Figure 2:
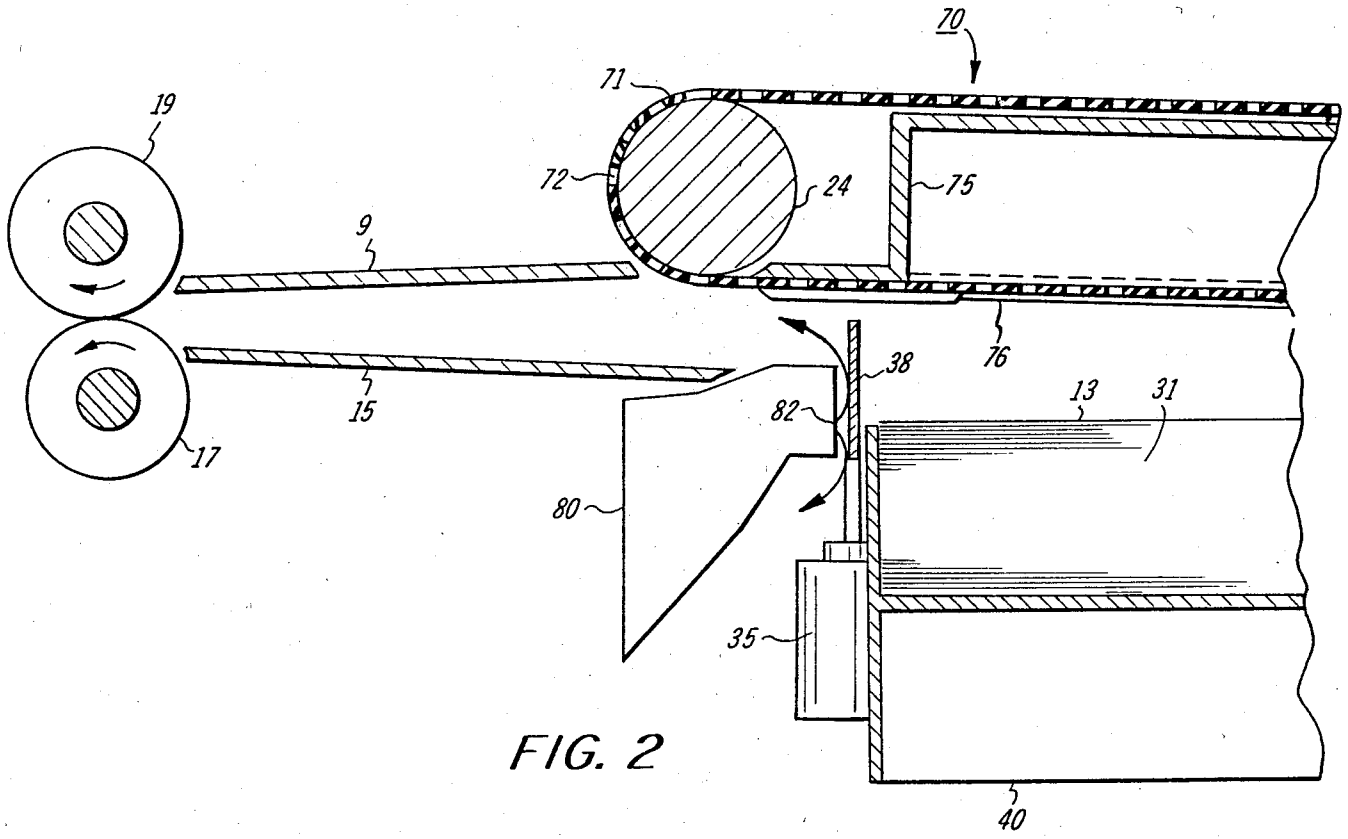
FIG. 2 is an enlarged cross-sectional view of the exemplary feeder in FIG. 1 which employs the present invention.
Figure 3:
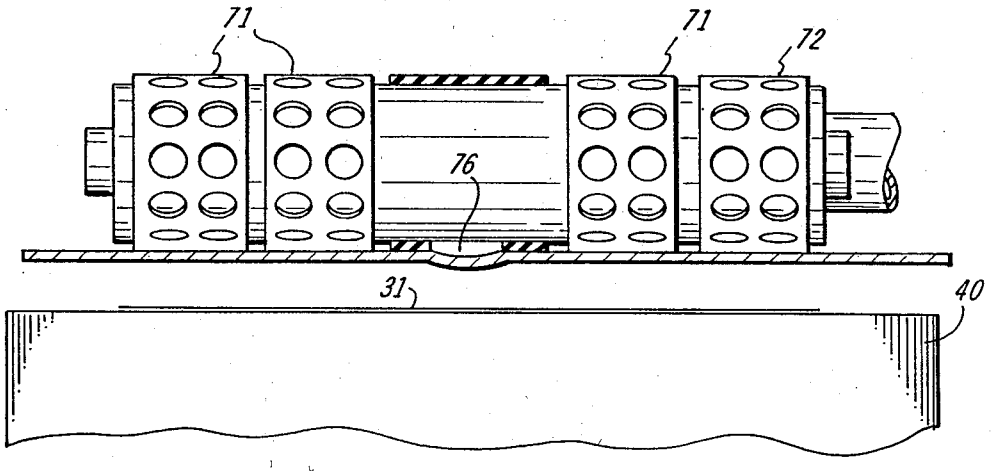
FIG. 3 is a partial front end view of the paper tray shown in FIG. 2.

Referring now to a particular aspect of the present invention, FIG. 2 shows a system employing the present invention in a copy sheet feeding mode. Alternatively or in addition, the sheet feeder may be mounted for feeding document sheets to the platen of a printing machine. The sheet feeder is provided with a conventional elevator mechanism (not shown) for raising and lowering either tray 40 or a platform within tray 40. Ordinarly, a drive motor is actuated to move the sheet stack support tray 40 vertically by a stack height sensor when the level of sheets relative to the sensor falls below a first predetermined level. The drive motor is deactuated by the stack height sensor when the level of the sheets relative to the sensor is above a predetermined level. In this way, the level of the top sheet in the stack of sheets may be maintained within relatively narrow limits to assure proper sheet separation, acquisition and feeding.

Vacuum corrugation feeder 70 and a vacuum plenum 75 are positioned over the front end of a tray 40 having copy sheets 31 stacked therein. A belt 71 is entrained around drive rollers 73 and 74 as well as plenum 75. Perforations 72 in the belt allow a suitable vacuum source (not shown) to apply a vacuum through plenum 75 and belt 71 to acquire sheets 31 from stack 13. Air knife 80 with nozzle 82 applies a positive pressure to the front of stack 13 to separate the top sheet in the stack and enhance its acquisition by vacuum plenum 75. A suitable air knife that could be used in the present invention is disclosed in commonly assigned U.S. Pat. No. 4,418,905 entitled Sheet Feeding Apparatus, and is incorporated herein by reference. Corrugation rail 76 is attached or molded into the underside of plenum 75 and causes sheets acquired by the vacuum plenum to bend during corrugation so that if a second sheet is still sticking to the sheet having been acquired by the vacuum plenum, the corrugation will cause the second sheet to detack and fall back into the tray. A sheet captured on belt 71 is forwarded through baffles 9 and 15 and into forwarding drive rollers 17 and 19 for transport to transfer station D.

In order to improve sheet acquisition and allow greater corrugation, a movable front blocking or intercept vane 38 is disclosed in accordance with the present invention. Introduction of the vane between the air knife and the copy sheet stack lead edge accomplishes two functions. First, the air knife flow is redirected, i.e., does not fight with the vacuum flow, and can be used to fluff the stack. The second function is to greatly improve the ability of the vacuum flow to acquire the top sheets. This is because the lead edge vacuum air flow can be redirected to flow along the stack lead edges and much higher vacuum levels for the same flow over prior systems can be attained due to the flow loss caused by the vane. The vane is controlled by solenoid 35 which is actuated at a predetermined time after air knife 30 has been ON to block nozzle 32. Once a vacuum is obtained on a sheet, a conventional signal to solenoid 35 causes it to retract removing vane 38 from in front of nozzle 82 so that air can again be directed against the front edge of the stack.

It should now be apparent that the separation capability of the vacuum corrugation feeder disclosed herein is highly sensitive to air knife pressure against a sheet stack as well as the amount of vacuum pressure directed against the top sheet in the stack. Disclosed herein is an improvement to the conventional vacuum corrugation top feeder and comprises a movable front vane which redirects the air knife and vacuum flow and thereby increases the efficiency of the feeder by controlling flutter of the sheets in the sheet stack and allows greater vacuum acquisition of sheets or substrates of any kind.

In addition to the method and apparatus disclosed above, other modifications and/or additions will readily appear to those skilled in the art upon reading this disclosure and are intended to be encompassed within the invention disclosed and claimed herein.

What is claimed is:

1. A top sheet separator feeder for separating and forwarding sheets seriatim from the top of a stack of sheets to be fed comprising a stack tray for supporting a stack of sheets to be fed, endless vacuum belt means extending over at least the front end of the sheet stack tray for acquiring and advancing the top sheet of the stack, said vacuum belt means extending across a suport surface having vacuum ports therein for applying a negative pressure at the back of the belt means, air knife means positioned in front of the stack tray for applying air-pressure to the sheets in the stack tray to separate the top sheet from the next adjacent sheet, and moveable front vane means positioned at the front of the stack tray between said air knife and the stack tray and adapted to redirect flow of said air knife means away from said vacuum ports.

2. The separator-feeder of claim 1, wherein said moveable front vane means is adapted when in a first position to allow air to flow from said air knife means without redirection and when in a second position redirects the flow of said air knife means away from the front of the sheet stack tray.

3. A top sheet separator-feeder apparatus for separating and forwarding substrates in seriatim, comprising:

support means for supporting a stack of substrates, said support means having front, rear and side walls attached thereto;

air knife means located at the front of the substrate stack and adapted to apply air pressure to the stack in order to separate the top substrate of the stack from the next adjacent substrate;

vacuum means in position above the front edge of the stack for applying a vacuum with force sufficient to acquire the top substrate from the stack;

corrugation means for corrugating substrates as they are fed from the stack;

moveable front vane means positioned between said air knife means and the lead edge of the substrate stack adapted to redirect the flow of air pressure from said air knife away from the substrate stack lead edge and redirect the vacuum flow of said vacuum means along the lead edge of the substrate stack to accomplish higher vacuum levels for the same vacuum flow; and belt means entrained over said vacuum means and adapted to forward said substrates for further processing.

4. The apparatus of claim 3, wherein said moveable front vane in a first position allows air to flow from said air knife means without redirection and in a second position, redirects the flow of air from said air knife means in order to increase the vacuum of said vacuum means.

5. The separator-feeder of claims 4 or 2, wherein said moveable front vane means is repositioned from a redirecting to a non-redirecting position after each sheet is fed.

* * * * *